United States Patent [19]

Dennstedt

[11] Patent Number: 4,993,321

[45] Date of Patent: Feb. 19, 1991

[54] INKER UNIT FOR HIGH-SPEED ROTARY PRINTING PRESS

[75] Inventor: Wolfgang Dennstedt, Leipzig, German Democratic Rep.

[73] Assignee: VEB Kombinat Polygraph "Werner Lambertz" Leipzig, Leipzig, German Democratic Rep.

[21] Appl. No.: 445,746

[22] Filed: Dec. 4, 1989

[30] Foreign Application Priority Data

Dec. 23, 1988 [DD] German Democratic Rep. ..... 3238343

[51] Int. Cl.[5] ..... B41F 31/06; B41F 31/10

[52] U.S. Cl. ..... 101/350; 101/DIG. 33

[58] Field of Search ..... 101/349, 350, 351, 363, 101/348, 207-210, DIG. 48, DIG. 33

[56] References Cited

U.S. PATENT DOCUMENTS

| | | | |
|---|---|---|---|
| 1,691,745 | 11/1928 | Waldron | 101/DIG. 33 |
| 2,036,451 | 4/1936 | Wood | 101/DIG. 33 |
| 4,454,813 | 6/1984 | Barrois et al. | 101/349 |

*Primary Examiner*—J. Reed Fisher

*Attorney, Agent, or Firm*—Michael J. Striker

[57] ABSTRACT

An inker unit for a high-speed printing press which inker unit comprises an endless revolving ink transfer band arranged between ink fountain and ink transfer rolls for transferring ink from the ink fountain roll to the ink transfer roll and having a first run spaced from the outer surface of the ink fountain roll and a second run constantly engaging the ink transfer roll, a ductor roll for periodically moving the first run of the ink transfer band into engagement with the ink fountain roll, and a mechanism for displacing the ink transfer band tangentially relative to the outer surface of the ink fountain roll synchronously with oscillations of the ductor roll.

7 Claims, 6 Drawing Sheets

11.1
8.1
10.1
14.1
7
12.1
4.1
3
13
9.1
17
26
27
21
nF
20
6
25
22
23
nu
9.2
19
16
15
18
12.2
13.2
14.2
4.2
10.2
11.2
8.2

INKER UNIT FOR HIGH-SPEED ROTARY PRINTING PRESS

BACKGROUND OF THE INVENTION

The invention relates to an inker unit for a high-speed rotary printing press comprising an endless ink transfer band arranged between an ink fountain roller and an ink transfer roller.

In a printing press, ink feeding systems are designed to transfer ink from an ink fountain to an ink distribution system in accordance with the requirements of a printing form.

The principle of intermittent transfer of ink from an ink fountain roll to an ink distribution system by a ductor roll is widely used in modern printing presses especially offset printing presses because of its high accuracy. As it is known, the ductor roll performs an oscillating movement. It comes in turn in contact with the ink fountain roll and a first ink transfer roll whereby an ink film of a predetermined thickness, width, and length (corresponding to a printing width of the printing press) is transferred along the entire width of the ductor roll. Ink quantity supplied to the ink distribution system in a single stroke of the ductor roll corresponds to the volume of the ink film transferred by the ductor roll.

The rotating ductor roll is subjected alternatively, upon contact with the ink fountain roll and the ink transfer roll, to deceleration and acceleration jolts, respectively. In high-speed printing presses, the number of oscillating strokes in a unit of time is directly proportional to a rotational speed of a printing cylinder and is above the dynamic limit of the inker unit. This results in serious drawbacks. The major drawback consists in that the ink quantity transferred by one oscillating stroke of the ductor roll does not correspond any more to the predetermined ink requirement. Therefore, there is no consistency in ink supply. A further drawback consists in negative influence of the acceleration on the inker- and printing units. An increased oscillation decreases the quality of printing.

As an alternative to intermittently operating inker units, continuously operating film inker units were developed for high-speed rotary printing presses. However, these inker units are extremely sensitive to control, and do not react to ink supply. Drawbacks of these inker units led to development of combined ductor-film inker units, i.e., such as described in German reference No. 3,008,980. However, with these units, it has to be decided how printing work is to be executed, that is whether to use the full press speed and the film inker unit or reduced press speed and a ductor inker unit. The drawback of these combined inker units is increased costs connected with using oscillating mechanisms and adjusting devices. Besides, drawbacks of film inker units still remain.

A film inker unit is disclosed in German publication DE-OS 35 31 433. In this film inker unit, a continuous film transfer band is arranged between the ink fountain roll and the first inker transfer roll. A drawback of this inker unit consists in a relatively high wear of ink rolls and the ink transfer band due to differences in speed between the ink rolls and the ink transfer band. Also, a substantial damaging influence of the heat generated because of continuous frictional contact between the ink transfer band and the ink fountain roll should be taken into account. The abovementioned drawbacks complicate control of film supply in this inker unit.

SUMMARY OF THE INVENTION

The object of the invention is to provide an inker unit for a rotary printing press which combines advantages of conventional ductor inker units with advantages of continuous, slip- and jolt-free, substantially wearless ink supply systems. The object of the invention is achieved by providing an inker unit in which for effecting ink transfer, between the ink fountain roll and the ink transfer roll, there is provided an ink transfer band which engages the relatively low-speed ink fountain roll and the relatively high-speed ink transfer roll slip- and jolt-free.

According to the invention, the ink transfer band revolves about two spaced guide rollers supported for a joint reciprocal movement. The relative position of the ink fountain roll, the guide track of the guide rollers and the ink transfer roll are so selected that one run of the ink transfer band constantly engages the outer surface of the ink transfer roll while the other run of the ink transfer band is separated from the outer surface of the ink fountain roll by a gap. An oscillating ductor roll insures periodical engagement and disengagement of the other run of the ink transfer band with the outer surface of the ink fountain roll. Reciprocating rollers provide for reciprocation of the ink transfer band tangentially to the outer surface of the ink transfer roll synchronously with a ductor roll cycle. The ductor roll oscillating mechanism, which is conventional, and a common translational mechanism for both guide rollers are connected with the press drive. The revolving movement of the ink transfer band and the rotational movement of the ink fountain roll are executed in the same direction. The translational movement of ink transfer band and the rotational movement of the ink fountain roll are executed in opposite direction when they contact each other. By an appropriate design, it is assured that, upon contact, a speed vector of a band element resulting from revolving and translational movements of the ink transfer band and the speed vector of an outer surface element of the ink fountain roll are equal to each other as in magnitude so in direction.

Due to constant engagement of a respective run of the ink transfer band with the ink transfer roll, the band will be frictionally driven by the ink transfer roll with a relatively high speed of the plate cylinder. The ductor roll, as already discussed above, insures periodical engagement and disengagement of the other run of the ink transfer band with the ink fountain roll. The ink transfer band will also tangentially reciprocate relative to the ink fountain roll synchronously with the oscillating movement of the ductor roll. This insures timely coincidence of engagement of the ink transfer band and the ink fountain roll with rotational movement of the ink fountain roll in a direction opposite to the direction of translational movement of the ink transfer band, and timely coincidence of disengagement of the ink transfer band from the ink fountain roll with rotational movement of the ink fountain roll in the same direction as the direction of translational movement of the ink transfer band. By appropriate calculations, a narrow ink film of predetermined thickness, length, and width will be transferred slip- and jolt-free from the ink fountain roll to the ink transfer band and therefrom, again slip- and jolt-free, the ink film will be transferred to the ink transfer roll. The ink quantity transferred to the press ink distribution system per each ductor oscillation cycle, as in conventional ductor inker systems, will correspond to the volume of the ink film and, at a predetermined thickness of the ink layer, will be directly proportional to the ratio of the rotational speed of the ink fountain roll t the rotational speed of the plate cylinder.

According to the invention, the guide rollers are reciprocally supported on respective guide rods by guide sleeves. The guide sleeves and the guide rods form respective guides.

According to a further aspect of the invention, the translational mechanism for moving the guide rollers comprises a flexible drive including drive gears, an endless tension member (a chain or tooth belt) and gears. Carriers fixedly connected with the tension member are rotatably supported in slides of cross-supports which are reciprocally supported on guide rods. The flexible drive is connected with the press drive by a gearing.

The cross-supports are fixedly connected with bearing supports of guide rollers. According to the invention, the gearing comprises a differential mechanism that includes two driving gears and a driven gear. One of the driving gears is connected with the drive of the ink fountain roll. The other of the driving gears is connected with the drive of the ink transfer roll. The driven gear is connected with the drive gears of the translational mechanism. The advantage of such an arrangement consists in that the ink fountain roller can be driven at a variable speed to adjust metering of ink.

According to another aspect of the present invention, there is provided a rotatable pressure roll for insuring force-locking engagement of the ink transfer band with the ink transfer roll. This insures a slip-free drive of the ink transfer band.

The present invention both as to its construction so to its mode of operation, together with additional objects and advantages thereof, will be best understood from the following detailed description of the preferred embodiments with reference to the accompanying drawings.

DESCRIPTION OF THE PREFERRED EMBODIMENTS

Figure 1:
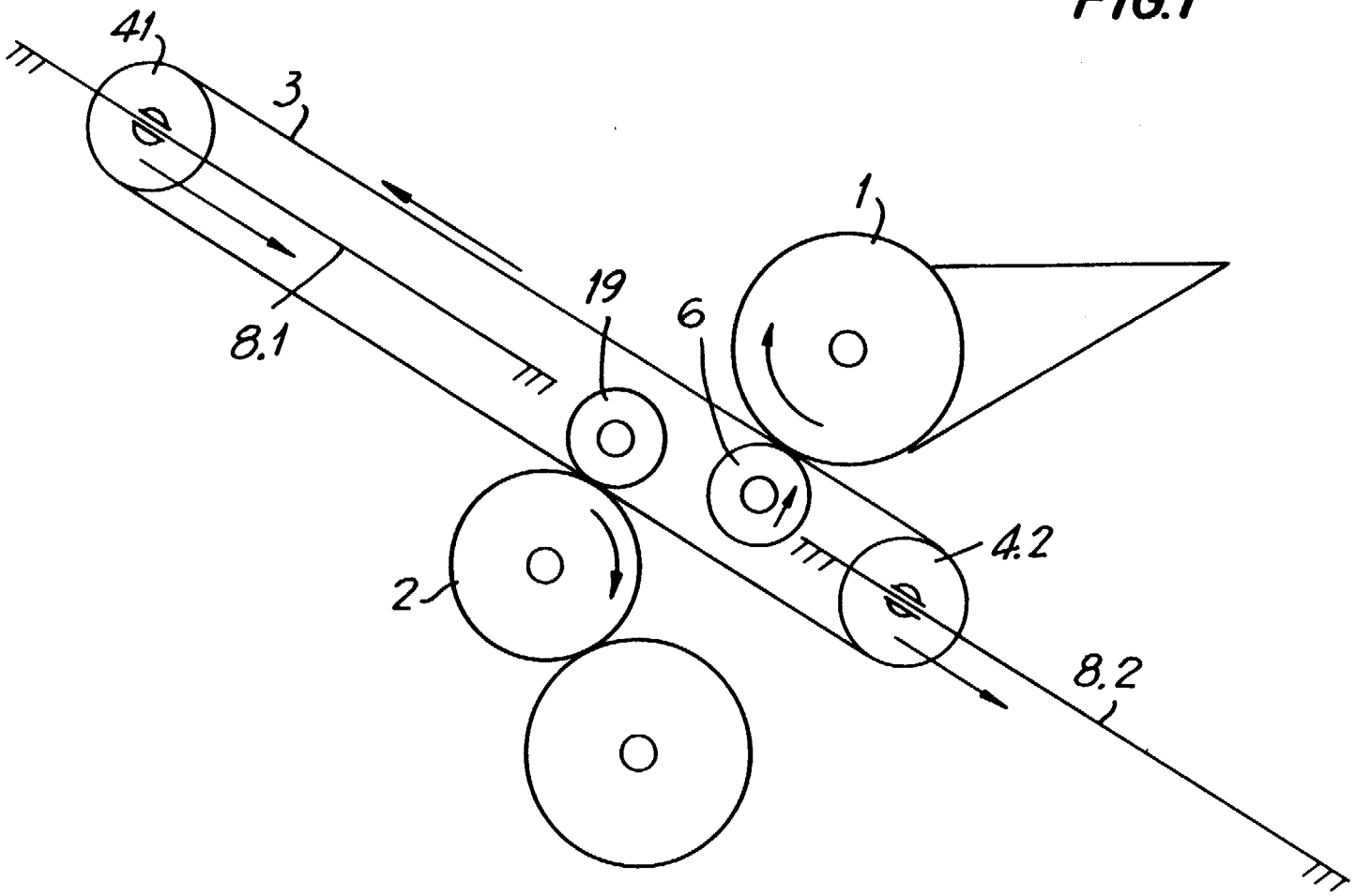
FIG. 1 shows a schematical side view of inker unit according to the invention with a rectilinear ink transfer band, which reciprocates in the plane of reference, in an engaging condition thereof when the ink transfer band engages the ink fountain roll.
Figure 2:
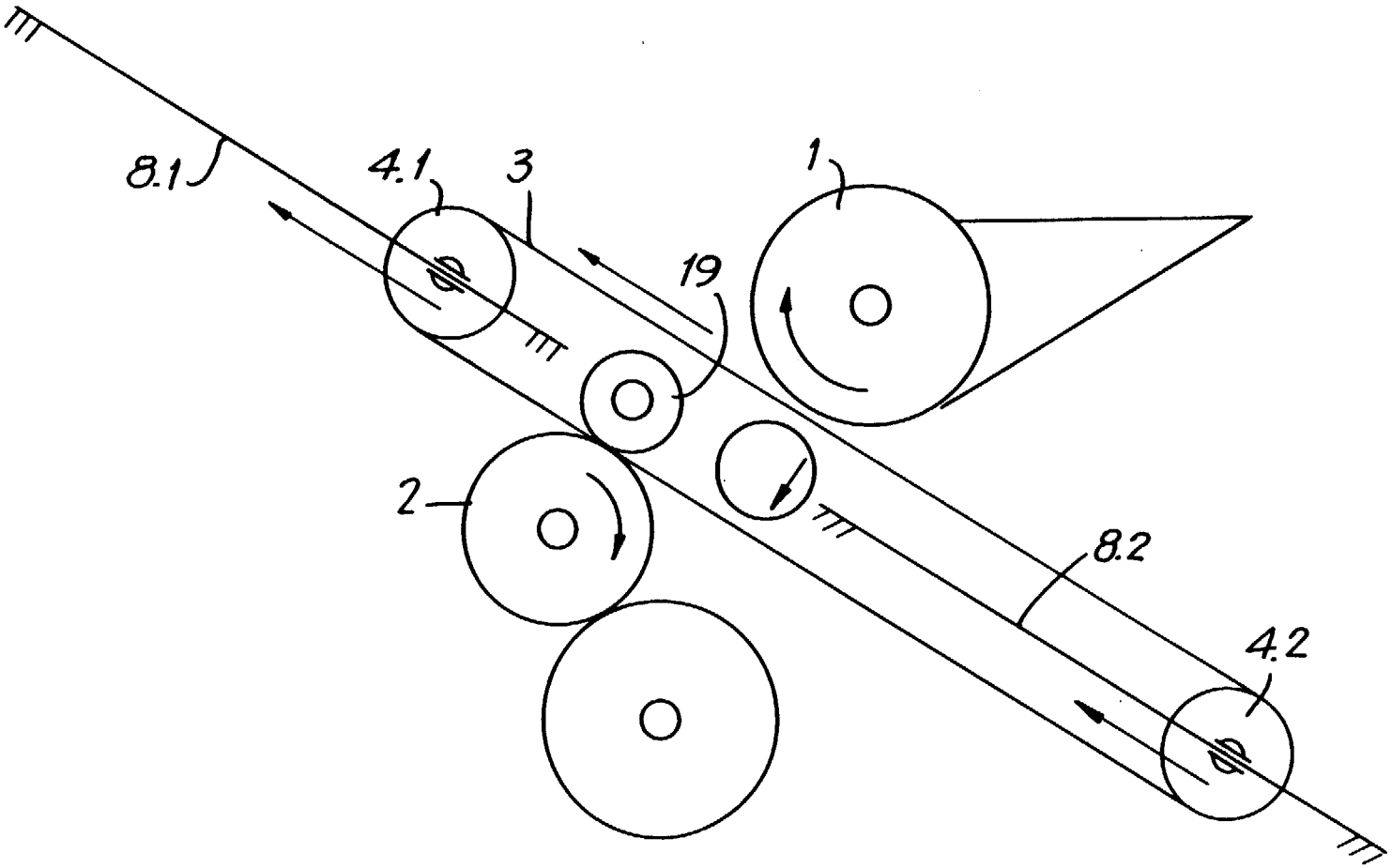
FIG. 2 shows the same view as FIG. 1 but in nonengaging condition of the ink transfer band.
Figure 3:
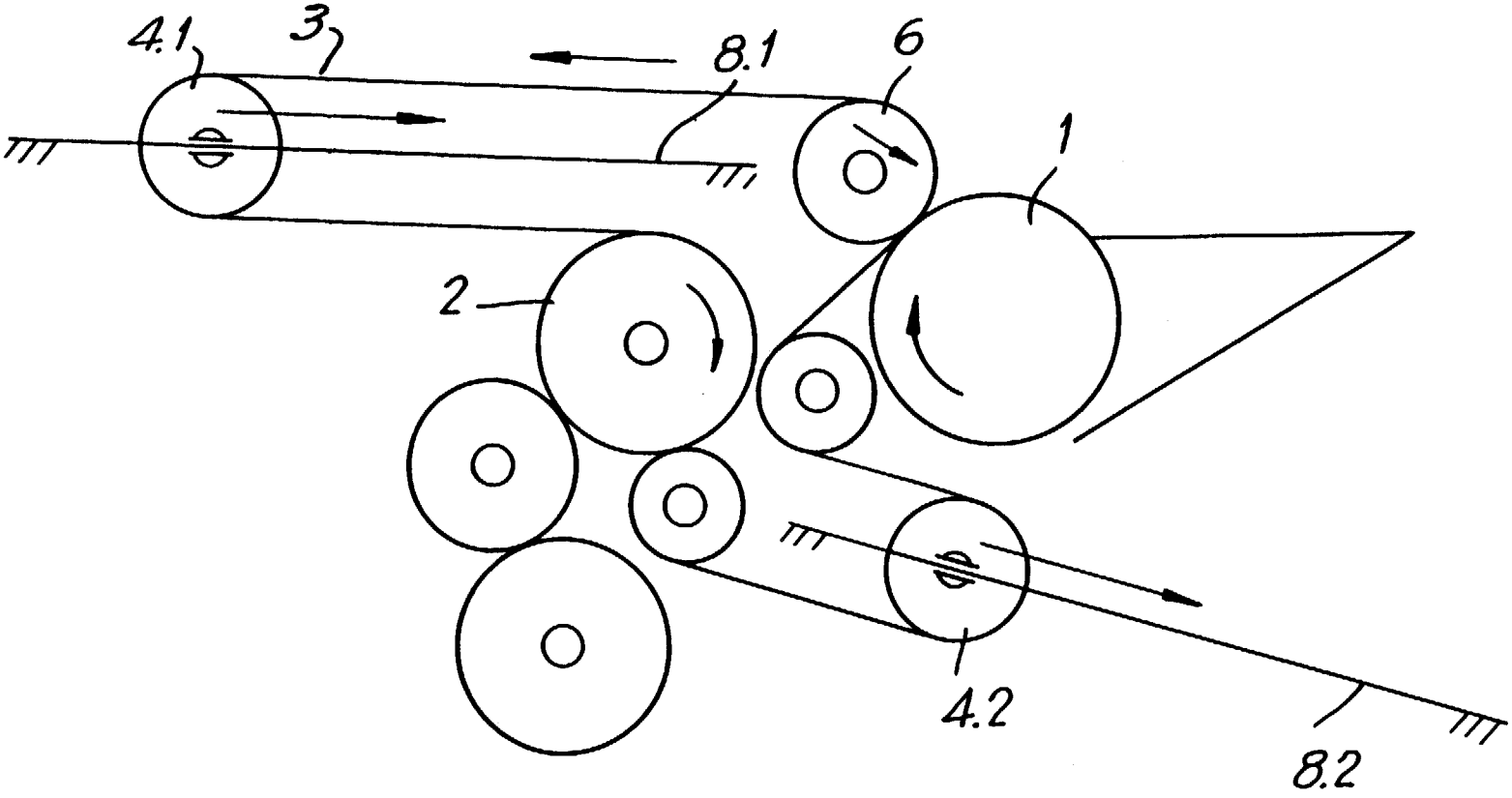
FIG. 3 shows a schematical side view of another embodiment of an inker unit with guide rollers reciprocating in different reference planes in an engaging condition of the ink transfer band.
Figure 4:
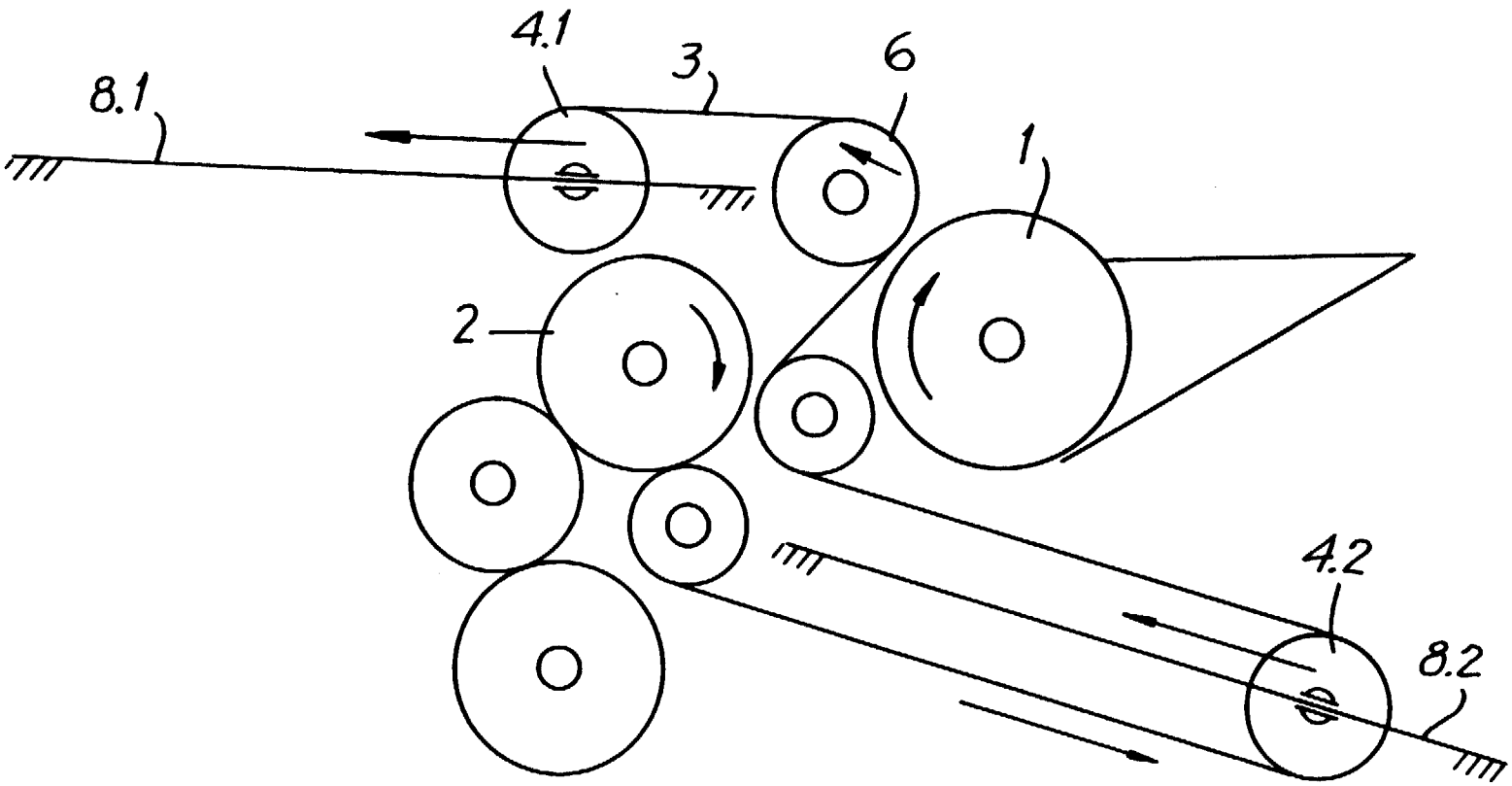
FIG. 4 shows the same view in a non-engaging condition of the ink transfer band.
Figure 5:
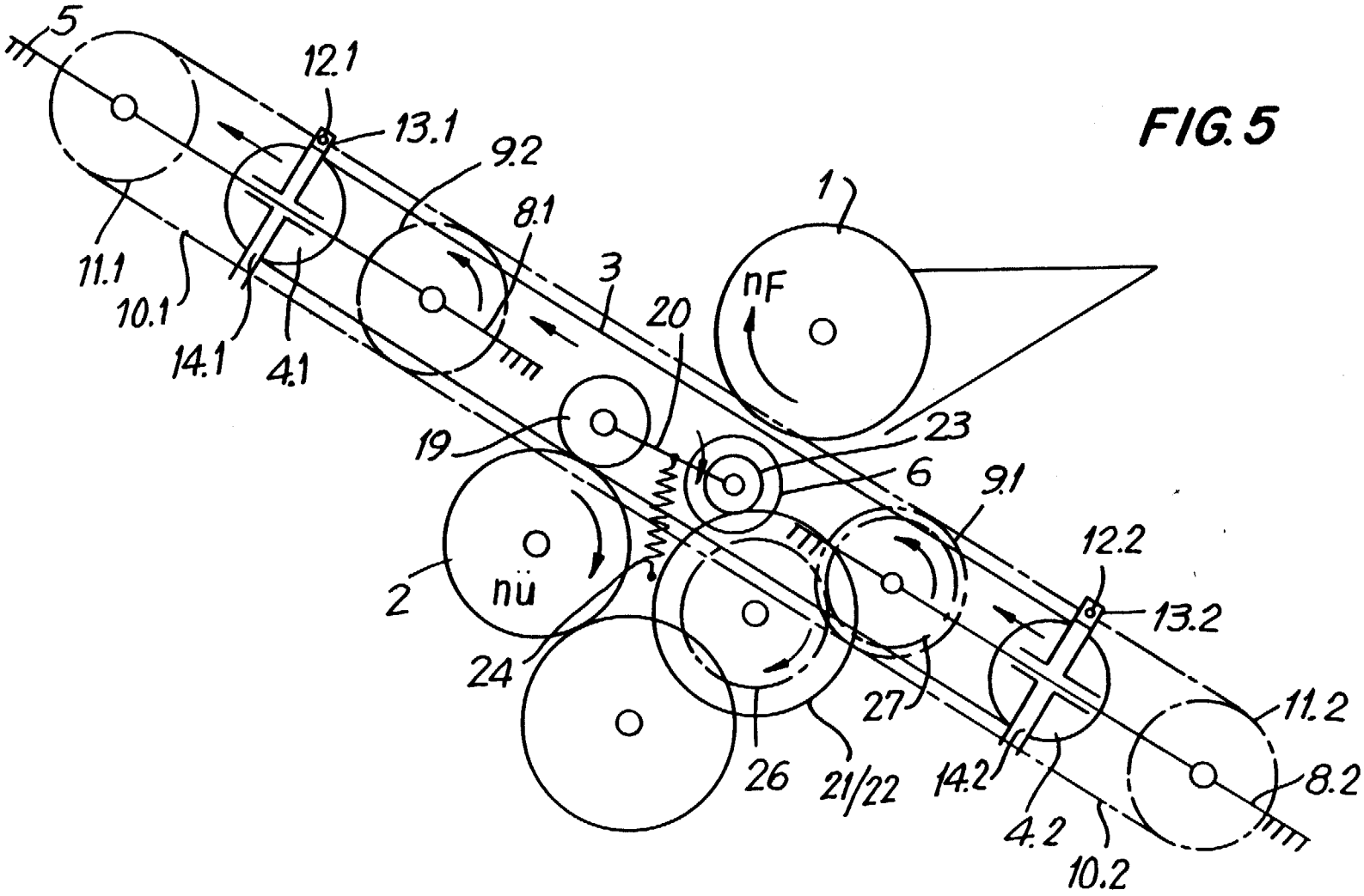
FIG. 5 shows a schematical side view of the guide rolls and an associated flexible drive of an inker unit according to the invention.
Figure 6:
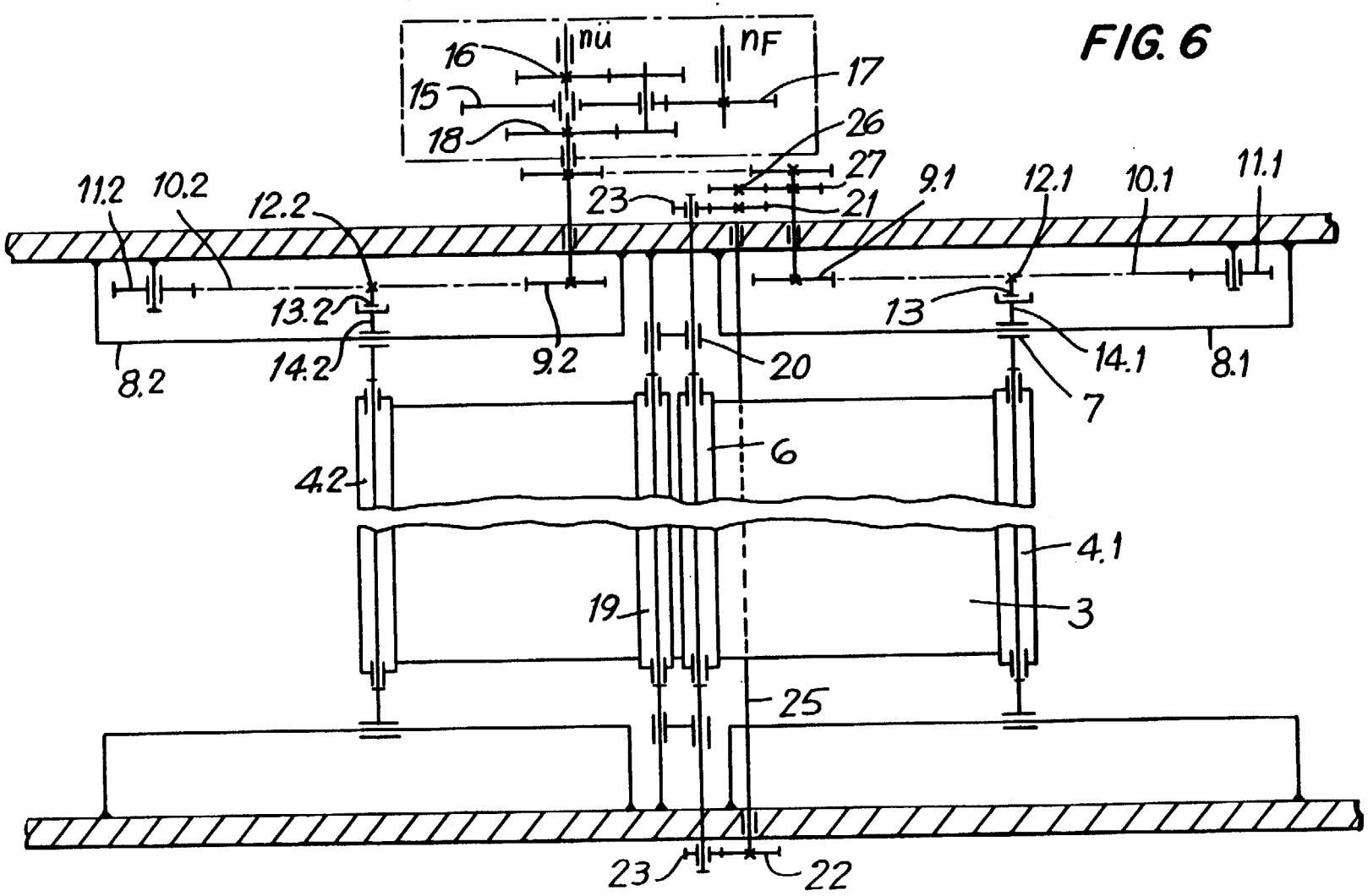
FIG. 6 shows schematically a top view of the guide rolls and the flexible drive together with a gear drive for actuating the flexible drive.

An inker unit according to the invention comprises a continuously rotatable at a relatively low rotary speed ink fountain roll 1, an ink transfer roll 2 of an ink distribution system (not shown) rotatable at a relatively high speed of a plate cylinder, and a continuous ink transfer band 3 displaceable between the ink fountain roll 1 and the ink transfer roll 2. According to the invention, the ink transfer band 3 is driven over two guide rollers 4.1 and 4.2, which are supported for joint, reciprocal displacement, in opposite directions. The relative positions of the ink fountain roll 1, the guide track 5 of the guide rollers 4.1 and 4.2, and the ink transfer roll 2 are so selected that one run of the ink transfer band constantly engages the outer surface of the ink transfer roll 2 while the other run of the ink transfer band 3 is separated from the outer surface of the ink fountain roll by a gap. An oscillating ductor roll 6 insures periodical engagement and disengagement of the other run of the ink transfer band 3 with the outer surface of the ink fountain roll. Guide rollers 4.1 and 4.2 provide for reciprocation of the ink transfer band 3 tangentially to the outer surface of the ink transfer roll synchronously with a ductor roll cycle. The ductor roll oscillating mechanism which is conventional, is posivitely connected with the press drive and a common translational mechanism for driving the guide rollers 4.1 and 4.2 and which is positively connected with the press drive. The revolving movement of the ink transfer band and the rotational movement of the ink fountain roll are executed in the same direction. The translational movement of ink transfer band 3 and the rotational movement of the ink fountain roll are executed in opposite direction when they contact each other. Generally, the revolving speed and the translational speed of the ink transfer band and the rotational speed of the ink fountain roll is so adjusted that, upon contact, the resulting speed vector of a band element and the speed vector of an outer surface element of the ink fountain roll ar equal to each other as in magnitude so in direction. The guide rollers 4.1 and 4.2 are reciprocally supported on respective guide rods 8.1 and 8.2 by guide sleeves 7. The guide sleeves 7 and the guide rods 8.1 and 8.2 form respective guides. The translational mechanism for moving the guide rollers 4.1 and 4.2 comprises a flexible drive including drive gears 9.1 and 9.2, an endless tension member 10.1 and 10.2 (a chain) and gears 11.1 and 11.2. Carriers 12.1 and 12.1 fixedly connected with the tension member are rotatably supported in slides 13.1 and 13.2 of cross-supports 14.1 and 14.2 which are reciprocally supported on guide rods 8.1 and 8.2. The drive gears 9.1 and 9.2 are positively connected with the press drive via a gearing 15 and a differential drive. The cross-supports 14.1 and 14.2 are fixedly connected with bearing supports of guide rollers 4.1 and 4.2. The gearing 15 includes drive gears 16 and 17 connected with drives of the ink fountain roll 1 and the ink transfer roll 2, respectively. The gearing 15 also includes a driven gear 18 connected with the drive gears 9.1 and 9.2 of the translational mechanism. A pressure roller 19 provides for force-locking engagement of the ink transfer band with the ink transfer roll. The ductor roll oscillating mechanism includes arm 20 one end of which is connected with the axle of the ductor roll 6 and the other end of which is pivotally connected with the axle of the pressure roller 19. Cam discs 21 or 22 and transfer rollers supported on the axle of the ductor roll 6, form driving and driven members of the ductor roll drive. The cam discs 21 and 22 are supported on a common shaft 25. A tension spring 24 connected with the arm 20 biases the transfer rollers into engagement with the cam discs. A gear 26 supported on the shaft 25 is engaged with gear 27 also driven from the gear 18. Thereby a synchronous movement of the transfer band 3 and the ductor rool 6 is insured.

While the invention has been illustrated and described as embodied in an inker unit for a high-speed rotary printing press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An inker unit for a high-speed printing press having a drive, said inker unit comprising an ink fountain roll continuously rotatable in a predetermined direction; an ink transfer roll; and endless ink transfer band arranged between said ink fountain and ink transfer rolls for transfering ink from said ink fountain roll to said ink transfer roll, said ink transfer band revolving in the predetermined direction of rotation of said ink fountain roll and having a first run spaced from an outer surface of said ink fountain roll, and a second run constantly engaging an outer surface of said ink transfer roll, said ink transfer band being driven by said ink transfer roll; an ductor roll for moving said first run of said ink transfer band periodically into engagement with said ink fountain roll; two spaced guide rollers supporting said ink transfer band for revolving movement thereof; means for supporting said two guide rollers for joint translational reciprocating movement; and means for translationally reciprocating said two guide rollers synchronously with a ductor roll cycle, whereby said ink transfer band is tangentially linearly displaceable relative to said outer surface of said ink fountain roll in synchronism with the ductor roll cycle, said ink transfer band being linearly displaceable, when engaging said ink fountain roll, in a direction opposite to the direction of rotation of said ink fountain roll, speeds of revolving and linear movements of said ink transfer band and a rotational speed of said ink fountain roll being chosen so that, at engagement of said ink transfer band with said ink fountain roll, a resulting speed vector of a contact surface area of said ink transfer band and speed vector of a respective surface area of said outer surface of said ink transfer roll have the same magnitude and direction.

2. An inker unit as set forth in claim 1, wherein said supporting means includes guide rod means and sleeve means for supporting said two guide rollers for displacement on said guide rod means.

3. An inker unit as set forth in claim 1, wherein said translationally reciprocating means comprises a flexible drive including drive gear means, an endless tension member displaceable thereby, and reversible gear means for reversing direction of movement of said flexible sleeve; carrier means fixedly connected with said endless tension member, slide means for rotatably supporting said carrier means, cross-support means fixedly connected with said two guide rollers and supporting said slide means, said cross-support means being supported on guide rod means for translational displacement therealong, and gearing means connected with the drive of the printing press for driving said translationally reciprocating means.

4. An inker unit as set forth in claim 1, wherein said supporting means comprises a common guide.

5. An inker unit as set forth in claim 1, further comprising a rotatable pressure roller for biasing said ink transfer band into constant engagement with said ink transfer roll.

6. An inker unit as set forth in claim 3, further comprising drive means for oscillating said ductor roller and gear means for connecting said drive means with the printing press drive and said gearing means whereby displacement of said transfer band relative to said outer surface of said ink fountain roll in synchronism with the ductor roll cycle is insured.

7. An inker unit according to claim 3, wherein said gearing means comprises a differential drive for driving said translationally reciprocating means in accordance with rotational movement of said ink fountain and ink transfer rolls.

* * * * *